US009624744B2

(12) United States Patent
Gerrard

(10) Patent No.: US 9,624,744 B2
(45) Date of Patent: Apr. 18, 2017

(54) APPARATUS FOR SUBTERRANEAN TOOL ACTUATION USING STORED TORSIONAL SPRING ENERGY

(71) Applicant: Baker Hughes Incorporated, Houston, TX (US)

(72) Inventor: David P. Gerrard, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 753 days.

(21) Appl. No.: 13/947,685

(22) Filed: Jul. 22, 2013

(65) Prior Publication Data

US 2015/0021012 A1 Jan. 22, 2015

(51) Int. Cl.
*E21B 23/01* (2006.01)
*E21B 23/00* (2006.01)

(52) U.S. Cl.
CPC ..... *E21B 23/01* (2013.01); *E21B 23/00* (2013.01)

(58) Field of Classification Search
CPC ..... E21B 23/00; E21B 23/01
See application file for complete search history.

(56) References Cited

U.S. PATENT DOCUMENTS

| | | | | |
|---|---|---|---|---|
| 4,660,863 | A * | 4/1987 | Bailey | E21B 29/10 166/207 |
| 7,540,329 | B2 | 6/2009 | Fay et al. | |
| 7,546,872 | B2 | 6/2009 | McGilvray, Jr. et al. | |
| 7,624,797 | B2 | 12/2009 | Fay | |
| 7,819,198 | B2 | 10/2010 | Birckhead et al. | |
| 2008/0217000 | A1 * | 9/2008 | Palmer | E21B 23/04 166/118 |

* cited by examiner

*Primary Examiner* — David Andrews
*Assistant Examiner* — Kristyn Hall
(74) *Attorney, Agent, or Firm* — Steve Rosenblatt

(57) ABSTRACT

A coiled spring is extended axially and its outside diameter is reduced for the run in position of a tool preferably a liner hanger. Upon release of the stored potential energy the diameter of the spring grows so that contact of the surrounding tubular is made by the spring to at least in part support one string to another. Alternatively, the rotational force from unwinding the spring can drive a slip or other support member radially outwardly into contact with the surrounding tubular and if desired lock the gripping position between the tubulars. Unexpended potential energy of the unwinding spring can also be a residual force to hold the expanded spring to the surrounding tubular. The axial shrinkage of the coiled spring can also be deployed in actuation of the slip in conjunction with rotational movement to advance the slip radially for a grip of the surrounding tubular.

21 Claims, 4 Drawing Sheets

APPARATUS FOR SUBTERRANEAN TOOL ACTUATION USING STORED TORSIONAL SPRING ENERGY

FIELD OF THE INVENTION

The field of the invention is actuation systems and methods for subterranean tools using wound coiled springs and more particularly where the rotation of the unwinding spring is the functioning member for securing strings or actuates another member in rotation to secure strings together.

BACKGROUND OF THE INVENTION

Springs have been used to store force and then when actuated to release an axial force to advance slips to actuate a liner hanger for securing one string to another. In some instances the stored force is in the form of a shape memory spring that extends its length when brought past its critical temperature using well fluids or with artificial heat added. Such a device is illustrated in U.S. Pat. No. 7,624,797. In other instances springs are used as drag devices so that relative movement can be created to actuate slips on a ramp and grab an adjacent tubular. Such a system is illustrated in U.S. Pat. No. 7,540,329. Another assembly that uses axial extension of springs to set slips is illustrated in U.S. Pat. No. 7,546,872. In another application a strip of steel sheet is coiled and held in a compact position as a lock that when released allows another component to move to actuate a downhole tool. U.S. Pat. No. 7,819,198 illustrates the breaking of a fusible link with current that allows a coiled spring to open up to release a grip on a mandrel so that actuating components of a tool become free to move and actuate a tool.

What has not been done in the realm of springs in actuation of tools is to either use the change in shape of the spring as it is allowed to relax as the actual load bearing component alone or in conjunction with other devices that are radially extended with rotary motion induced by the selective unwinding of the spring or springs. The present invention is directed to devices and related methods that used the stored potential energy of springs that when reshaped to store force experience a decrease in radial dimension and an increase in axial dimension. Release of such springs brings about rotational movement as well as a shrinking in length and an increase in radial dimension. One or more of these effects are harnessed in the preferred embodiment to actuate a liner hanger. The spring itself can add a grip force onto an adjacent tubular with any remaining potential energy after radial dimensional growth action to support the holding force applied to the adjacent tubular. Additionally or alternatively the length shrinkage and rotation can drive a gripping member along an inclined guide surface for radial extension thereof to set slips and/or to lock the set position by actuation of a lock ring that permits slip movement in only the actuating direction. Those skilled in the art will appreciate more about the present invention from a review of the detailed description of the preferred embodiment and the associated drawings while recognizing that the full scope of the invention is to be determined from the appended claims.

SUMMARY OF THE INVENTION

A coiled spring is extended axially and its outside diameter is reduced for the run in position of a tool preferably a liner hanger. Upon release of the stored potential energy the diameter of the spring grows so that contact of the surrounding tubular is made by the spring to at least in part support one string to another. Alternatively, the rotational force from unwinding the spring can drive a slip or other support member radially outwardly into contact with the surrounding tubular and if desired lock the gripping position between the tubulars. Unexpended potential energy of the unwinding spring can also be a residual force to hold the expanded spring to the surrounding tubular. The axial shrinkage of the coiled spring can also be deployed in actuation of the slip in conjunction with rotational movement to advance the slip radially for a grip of the surrounding tubular.

DETAILED DESCRIPTION OF THE PREFERRED EMBODIMENT

Figure 1:
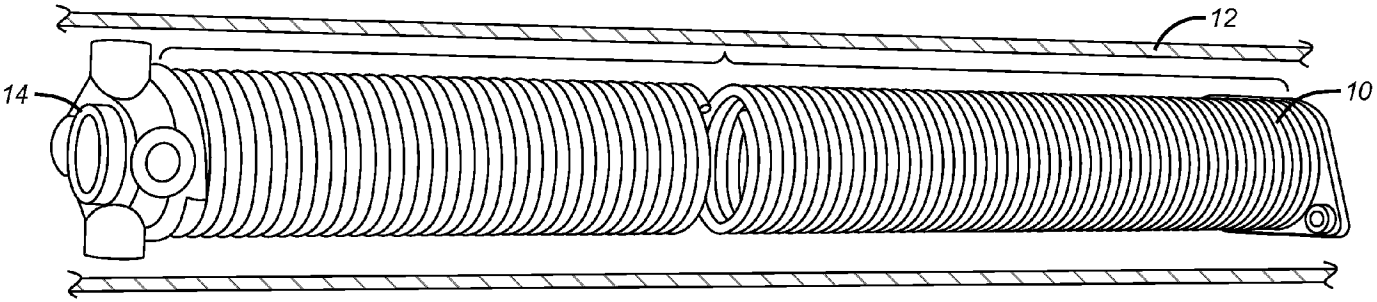
FIG. 1 is a view of a wound coiled spring in position inside a surrounding tubular before release.
Figure 2:
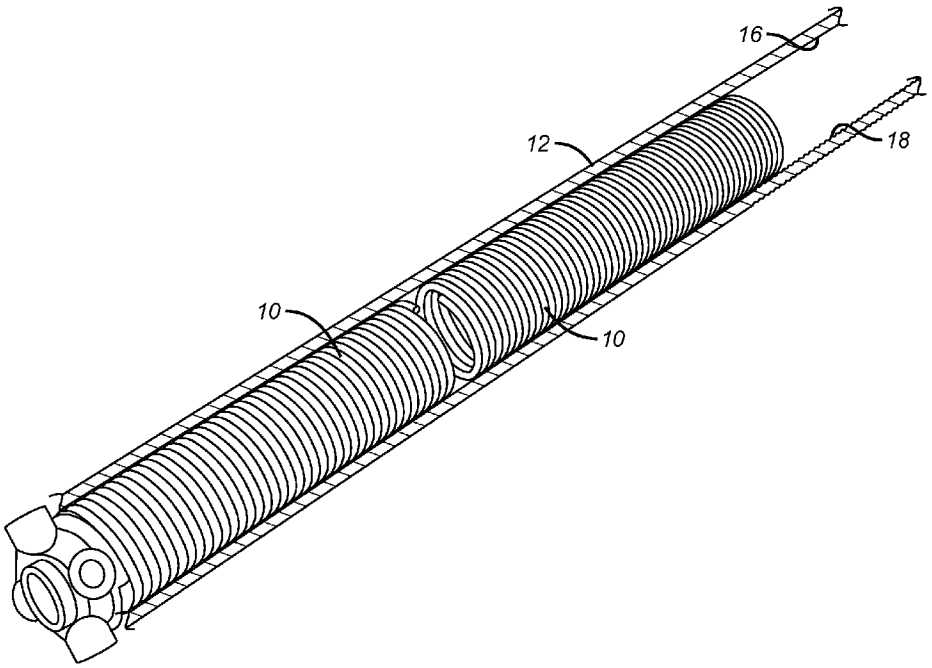
FIG. 2 is the view of FIG. 1 showing the spring released into a gripping position of the surrounding tubular.

FIGS. 1 and 2 illustrate the basic design of the present invention where a coiled spring 10 is energized by winding it tighter and as a result reducing its outside diameter and increasing its length so that it can be run inside a surrounding tubular 12. A mandrel 14 is schematically illustrated and can be the body of a liner hanger that supports a tubular string (not shown) to be supported from surrounding tubular 12. When released as shown in FIG. 2 the diameter of the spring 10 increases to contact the surrounding inside wall 16 of the tubular 12. The inside wall 16 of tubular 12 can have a spiral shape 18 so that the coils of spring 10 align themselves with the shape 18 to stabilize the coils of spring 10 until a release device that is not shown. Upon release of the coils 10 the radially outward movement to contact the inside wall 16 of tubular 12 brings the coils 10 away from the mandrel 14. Although a single spring is shown more than one spring can be used and the springs can be stacked or nested. It is noted that the coils of spring 10 come together as its potential energy is released which shortens its overall length. Apart from the length shortening there is also a rotational movement induced from the release of the wound spring. This rotational movement acts to increase the coil diameter until contact is made with the surrounding tubular is made. This contact expends at least some of the stored potential energy and what available potential energy that doesn't get consumed in the dimensional increase is available to act as a constant normal force onto the surrounding tubular 12 to enhance the grip of the coils into the spiral shape 18 for greater load bearing capacity.

Figure 3:
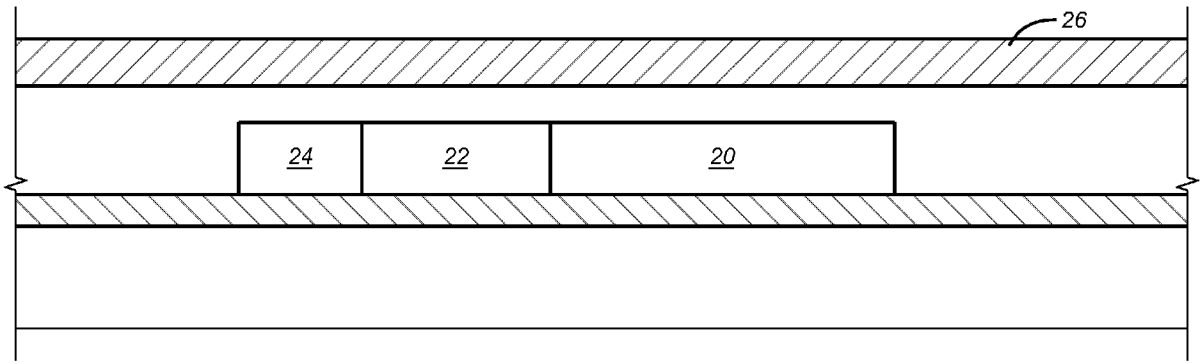
FIG. 3 is a schematic illustration of a run in position of an assembly of a coiled spring that can trigger a grip mechanism by rotation in the run in position.
Figure 4:
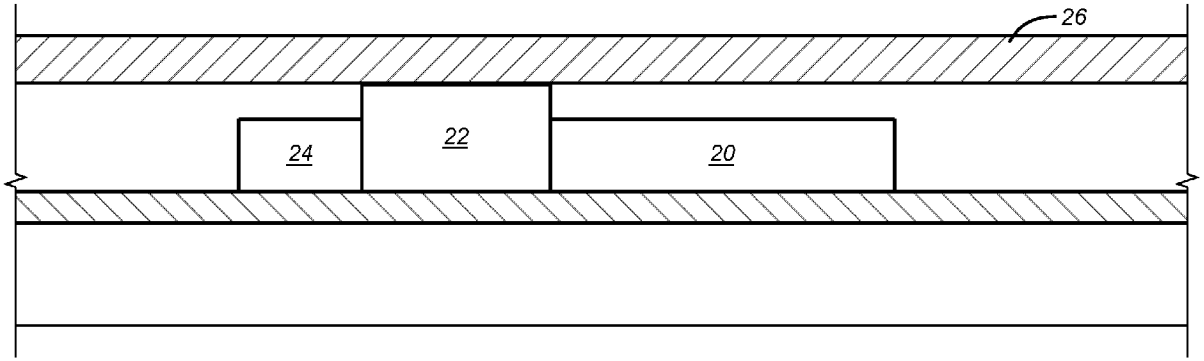
FIG. 4 is the view of FIG. 3 showing the release device operated and the unwinding of the spring actuating the grip on the surrounding tubular.
Figure 5:
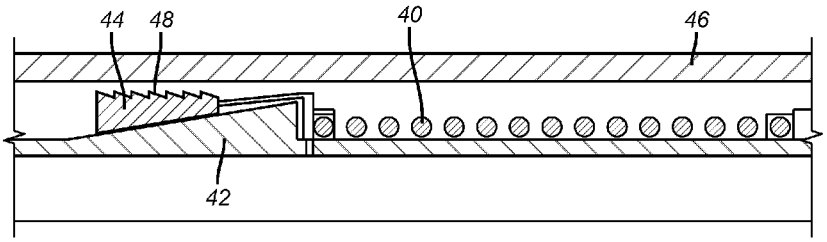
FIG. 5 is a more detailed view of FIGS. 3 and 4 showing the run in position with a grip device positioned by a ramp to be climbed by rotation provided from the spring unwinding.
Figure 6:
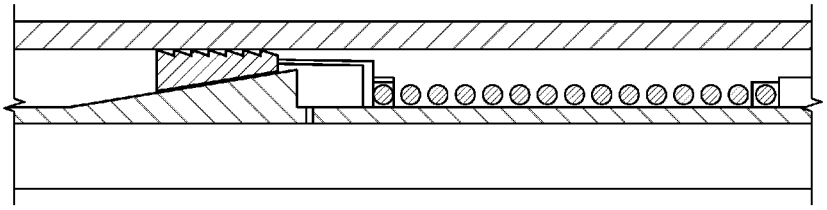
FIG. 6 is the view of FIG. 5 in the set position.
Figure 7:
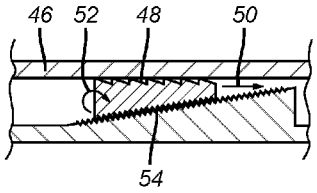
FIG. 7 is a detailed view of the slip in FIG. 6.
Figure 8:
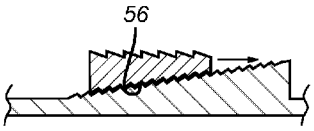
FIG. 8 is a view of the lock mechanism for the slip in FIG. 7.

FIGS. 3 and 4 illustrate conceptually the source of rotational potential energy 20 that works in conjunction with a grip member 22 and a release device 24. The grip member 22 is initially retracted for run in and the wound status of the potential energy source 20 such as a coiled spring is held in the wound condition by release device 24 that can be operated locally or remotely and actuated mechanically, hydraulically or by signal generated locally or from the surface. The actuation of the release device 24 extends the grip member radially to the surrounding tubular 26 which can be casing. The rotational energy generated by the potential energy source rotates the grip member 22 as the way to get it to radially extend. It should be noted that when the potential energy source 20 is a relaxing coiled spring that its overall length is shortened while its diameter increase and rotational movement of the coils is induced. Some or all of these movements can be deployed for securing one tubular to another. As described before the expansion of the spring coils can bring them in contact with the tubular 26 which as previously described can have an inner wall profile on the order of the same pitch and wire diameter of the spring so that the relaxing spring nests in that profile inside the tubular 26 to enhance the grip. Some of the potential energy of the source 20 can remain as a residual radial force to hold the spring coils in the internal profile of the surrounding tubular 26.

FIGS. 5-8 show the basic design of FIGS. 5-8 in more detail. A coiled spring 40 is secured to ramp 42 so that release of the spring 40 to relax will induce rotational movement of ramp 42 which in turn will move the slips 44 up the ramp and at the same time extend the slips 44 radially into contact with the surrounding tubular 46. The slips have teeth or wickers 48 that are designed to bite into the casing 46. Arrows 50 and 52 illustrate the rotational and axial movement of the slips 44 along the ramp 42. The opposing surfaces 54 can be flat or can have matching profiles such as a thread pattern or a series of steps as illustrated. The steps 56 can also act as a ratchet that allows movement of the slips 44 up the ramp 42 but prevents return movement. Other lock or ratcheting devices can be used to retain the spring 40 or the spring 10 in the relaxed position where the surrounding tubular is engaged either by the spring or by set slips as previously described.

Those skilled in the art will appreciate that the unwinding of a coiled spring with a resultant increase in its diameter as a result of rotational movement as it relaxes can be used in part to secure tubulars together or in other ways to actuate a subterranean tool by virtue of the ensuing contact between surfaces. In a variation, the rotational movement can be imparted to a gripping member to cause it to ride up a ramped surface such as by engaging thread forms or other shapes that can move the gripping member radially outwardly as it also moves axially due to the rotational motion imparted from the spring. The uncoiling spring can also shrink axially and impart another component of force to the gripping member. A locking profile can be located on the ramped surface to interact with the slips to get the motion limited to setting while limiting or precluding motion in the reverse direction.

The ramp orientation can anticipate the direction of loading on the slips so that such differential pressure loadings are additive to the bite of the slips. The ramps can be arrayed in one or two opposed directions if the anticipated differential pressure loading can come in opposite directions.

The wire shape of the coils can be rounder or can come to have a sharp exterior ridge that can be hardened so that the exterior surface of the coil act akin to wickers on slips with selective penetration into the surrounding wall of the outer tubular for enhanced fixation thereto.

The above description is illustrative of the preferred embodiment and many modifications may be made by those skilled in the art without departing from the invention whose scope is to be determined from the literal and equivalent scope of the claims below:

I claim:

1. A subterranean tool for supporting a first tubular from a second tubular, comprising:

a tubular housing having an end connection for support of said first tubular;

a potential energy source affixed about said housing that initiates relative rotational movement with respect to said housing when selectively released and remaining affixed after said selective release;

said potential energy source changing dimension by said relative rotation, while remaining affixed to said housing when selectively released, to directly engage the second tubular for supporting said housing and said first tubular affixed thereto to said second tubular.

2. The tool of claim 1, wherein:

said potential energy source comprises at least one coiled spring.

3. The tool of claim 2, wherein:

said at least one coiled spring comprises a plurality of coiled springs that are stacked or nested.

4. The tool of claim 2, wherein:

said coiled spring has coils that initially engage a conforming shape on said housing.

5. The tool of claim 2, wherein:

an outer surface of said coiled spring has a sharp edge oriented for contact with or penetration of the second tubular.

6. The tool of claim 2, wherein:

said spring supports the weight of said housing by engagement of the second tubular.

7. The tool of claim 1, further comprising:

a gripping member mounted to said housing for selective extension of the gripping member toward the second tubular.

8. The tool of claim 7, further comprising:

a ramp mounted to said housing, said ramp relatively rotatable with respect to said gripping member for extension of said gripping member.

9. The tool of claim 8, wherein:

said gripping member movement is limited to a direction that brings said gripping member toward the second tubular.

10. The tool of claim 8, wherein:

said gripping member relatively rotatably mounted to said ramp.

11. The tool of claim 8, wherein:

said gripping member relatively axially movable relative to said ramp.

12. The tool of claim 8, wherein:

said gripping member and said ramp define a ratchet therebetween to prevent gripping member movement along said ramp in a direction approaching said housing.

13. The tool of claim 8, wherein:

said gripping member rotates and moves axially relative ramp to said housing.

14. The tool of claim 13, wherein:

said potential energy source comprises at least one coiled spring.

15. The tool of claim 14, wherein:

said that least one coiled spring comprises a plurality of coiled springs that are stacked or nested.

16. The tool of claim 14, wherein:

said coiled spring has coils that initially engage a conforming shape on said housing.

17. The tool of claim 14, wherein:

an outer surface of said coiled spring has a sharp edge oriented for contact with or penetration of the second tubular.

18. The tool of claim 8, wherein:

said potential energy source comprises at least one coiled spring.

19. The tool of claim 18, wherein:

said that least one coiled spring comprises a plurality of coiled springs that are stacked or nested.

20. The tool of claim 18, wherein:

said coiled spring has coils that initially engage a conforming shape on said housing.

21. The tool of claim 18, wherein:

an outer surface of said coiled spring has a sharp edge oriented for contact with or penetration of the second tubular.

* * * * *